United States Patent [19]

Haltmeier et al.

[11] 4,071,055

[45] Jan. 31, 1978

[54] INSERTING CARRIER FOR LOOMS WITH REMOVAL OF A FILLING YARN FROM STATIONARY BOBBINS

[75] Inventors: Paul Haltmeier, Brugg; Erhard Freisler, Bubikon; Willy Rohr, Hinwil, all of Switzerland

[73] Assignee: Ruti Machinery Works Ltd., Ruti, Switzerland

[21] Appl. No.: 726,005

[22] Filed: Sept. 23, 1976

[30] Foreign Application Priority Data

Sept. 29, 1975 Switzerland ..... 12575/75

[51] Int. Cl.[2] ..... D03D 47/22

[52] U.S. Cl. ..... 139/448

[58] Field of Search ..... 139/447, 448

[56] References Cited

U.S. PATENT DOCUMENTS

| | | | |
|---|---|---|---|
| 3,842,867 | 10/1974 | Volpe | 139/448 |
| 3,931,837 | 1/1976 | Volpe | 139/448 |
| 3,960,183 | 6/1976 | Flamand | 139/447 |

*Primary Examiner*—Henry S. Jaudon

*Attorney, Agent, or Firm*—Donald D. Denton

[57] ABSTRACT

An inserting carrier for looms with removal of a filling yarn from stationary bobbins having a filling yarn clamping tongue which is swingable perpendicular to a central plane of the warp yarn and supported on the bottom surface of the carrier.

6 Claims, 7 Drawing Figures

INSERTING CARRIER FOR LOOMS WITH REMOVAL OF A FILLING YARN FROM STATIONARY BOBBINS

BACKGROUND OF THE INVENTION

The present invention relates to an inserting carrier for looms with removal of the filling yarn from stationary bobbins, having a filling yarn clamping device and a warp yarn divider piece developed on the top of the rear side wall of the carrier facing away from the tip of the shed, the upper edge of which divider piece is developed as an ascending first yarn guide curve and then passes into an open yarn groove which is covered by a horn which extends out in the direction away from the tip of the shed.

In one known inserting carrier, the filling yarn clamping device, which consists of a fixed jaw and a movable jaw pressed resiliently against the fixed jaw, is mounted on the front side wall of the carrier. The filling yarn tensioned between the yarn groove and the clamping device thus extends within the carrier in a plane lying approximately parallel to the central plane of the warp yarn. This horizontal filling yarn guide in the inserting carrier is disadvantageous particularly in the case of looms in which a flexible band is used as drive means for the carrier, since it is very difficult to hold the extending carrier so stable in the direction perpendicular to the central plane of the warp yarn that it can reliably grasp the offered filling yarn in the center of the shed.

In the case of another known inserting carrier, this disadvantage is avoided in the manner that the filling yarn clamping device is formed of a spring loaded clamping tongue which is swingable perpendicular to the central plane of the warp yarn and supported on the bottom surface of the inserting carrier. In the case of this inserting carrier, the yarn groove is arranged in the cover surface of the carrier and the filling yarn is thus guided in vertical direction in the inserting carrier. Actual practice has shown that a vertically guided filling yarn is grasped with much greater assurance by the extending carrier than a horizontally guided yarn. The arrangement of the yarn groove on the cover surface of the carrier leads however to the result that this inserting carrier has a warp divider piece not only at the head of its rear side wall but also at the head of its front side wall, the latter warp divider piece furthermore also protruding farther forward than the divider piece on the rear side wall. The warp divider piece on the front side wall increases the danger of loose warp yarns possibly catching in the inserting carrier and/or of the warp yarns being torn by it. An additional disadvantage is that no means are provided in connection with this known inserting carrier to prevent the feeding of possible loose warp yarns into the yarn groove and to the clamping tongue.

The closest prior art known to the applicants in connection with this application is the U.S. Pat. No. 3,638,686.

SUMMARY OF THE INVENTION

The present invention avoids the aforesaid disadvantages and it is characterized by the fact that the filling yarn clamping device is formed by a spring-loaded clamping tongue which is swingable perpendicular to the central plane of the warp yarn and supported on the bottom surface of the carrier, that a second yarn guide curve extending from the rear side wall of the carrier towards the front side wall adjoins the first yarn guide curve, and that a third yarn guide curve leading from the horn up to the clamping slot of the clamping tongue is provided.

The inserting carrier in accordance with the invention has only one warp divider piece, although the filling yarn is guided vertically in the carrier. This advantageous feature of the inserting carrier is obtained by the special shape and the cooperation of the second and third yarn guide curves.

Brief Description of the Drawings

These and other objects of the invention will be explained in further detail below on the basis of an illustrative embodiment and the drawings, in which.

DESCRIPTION OF THE PREFERRED EMBODIMENT

Figure 2:
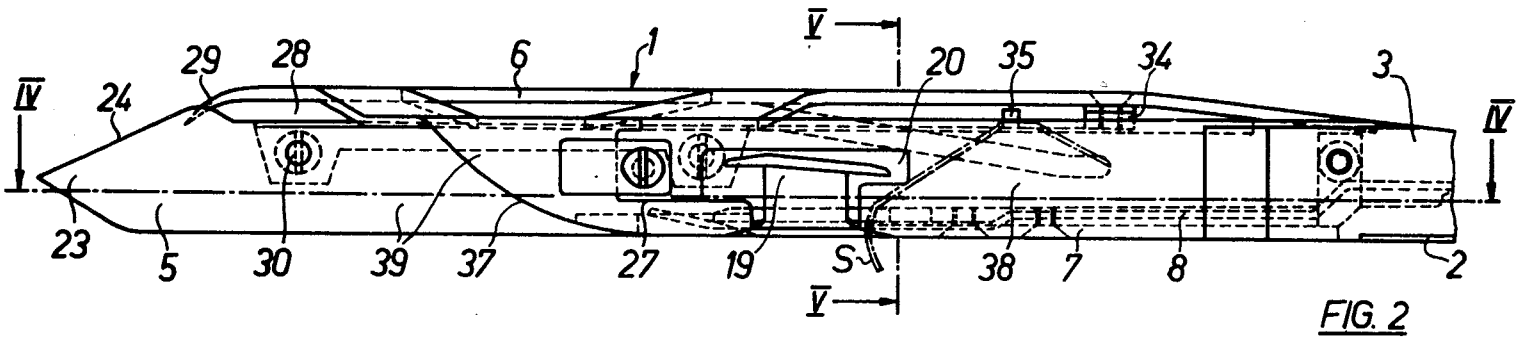
FIG. 2 is a view in elevation seen in the direction of the arrow II of FIG. 1.
Figure 1:
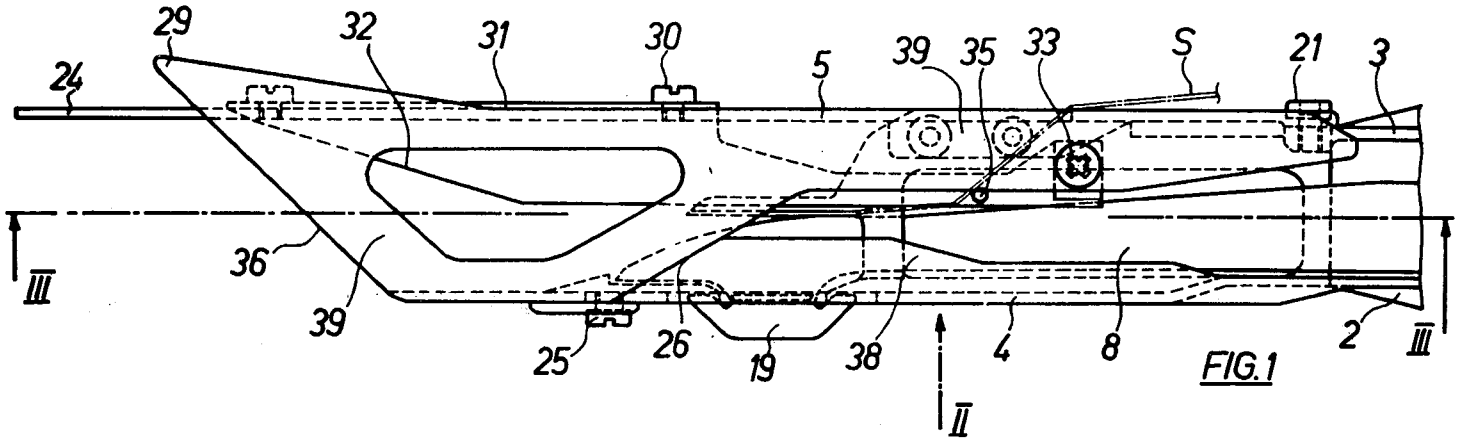
FIG. 1 is a top view of an inserting carrier.
Figure 3:
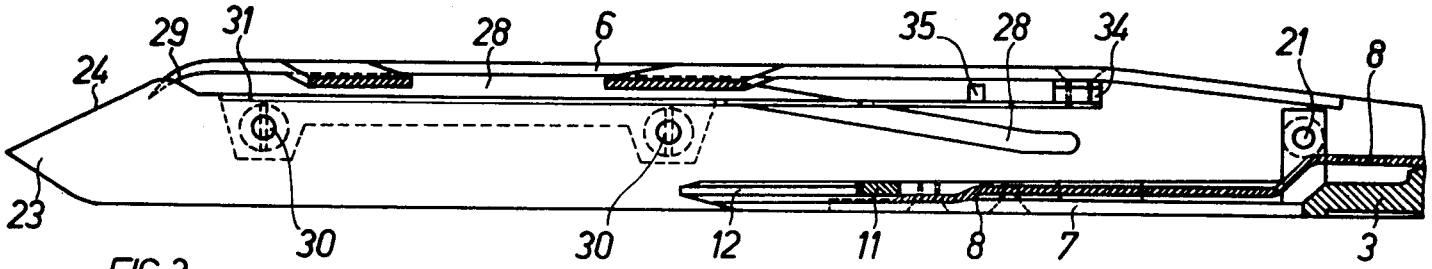
FIG. 3 is a sectional view taken along the line III—III of FIG. 1.
Figure 4:
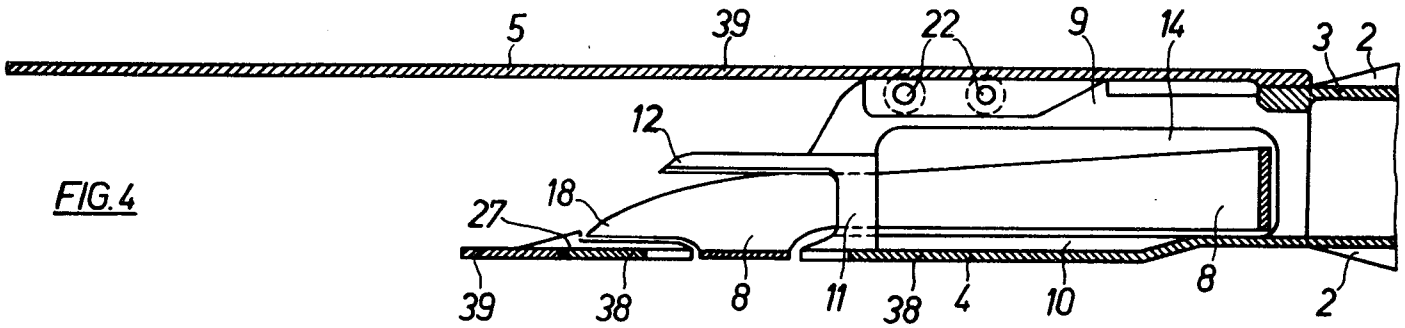
FIG. 4 is a sectional view taken along the line IV—IV of FIG. 2.

An inserting carrier 1 as shown in the figures has a base 3 of approximately U-shaped cross section which is firmly connected to a flexible steel band 2 which serves as the drive for inserting and removing the carrier from the shed of the loom. The base 3 has a front side wall 4 facing the point of the shed formed in operation by the warp yarns K whose central plane is designated M; a rear side wall 5; a cover surface 6; and a clamping tongue 8 which is supported in the region of the bottom 7 of the inserting carrier 1. The two side walls 4 and 5, the cover surface 6, and the carrier bottom 7 together with the clamping tongue 8 form a tunnel-shaped hollow space for the entrance of an extending carrier (not shown).

The shell of the hollow space, defined by the side surfaces 4 and 5, the cover surface 6 and the carrier bottom 7, is formed of two structural parts 38 and 39 of substantially U-shaped profile which are screwed together, the part 38 being open towards the top and the part 39 being open towards the bottom.

The part 38 is attached to the base 3 and forms the carrier bottom 7 and the greatest part of the front side wall 4. The structural part 38 is furthermore bent 90° on the upper edge of the front side wall 4 in the direction towards the rear side wall 5 and thus also forms a part of the cover surface 6.

The structural part 39 which adjoins the part 38 in the direction toward the point of the carrier forms the rear side wall 5, the greatest part of the cover surface 6, and a small part of the front side wall 4. The contact edge extending between the two structural parts is designated 26 in the cover surface 6, and 27 in the front side wall 4. The rear side wall 5 is attached by a screw to the base 3 and by two screws 22 to the carrier bottom 7. In the region of the front side wall 4, the structural parts 38 and 39 are screwed together by a screw 25.

Figure 5:
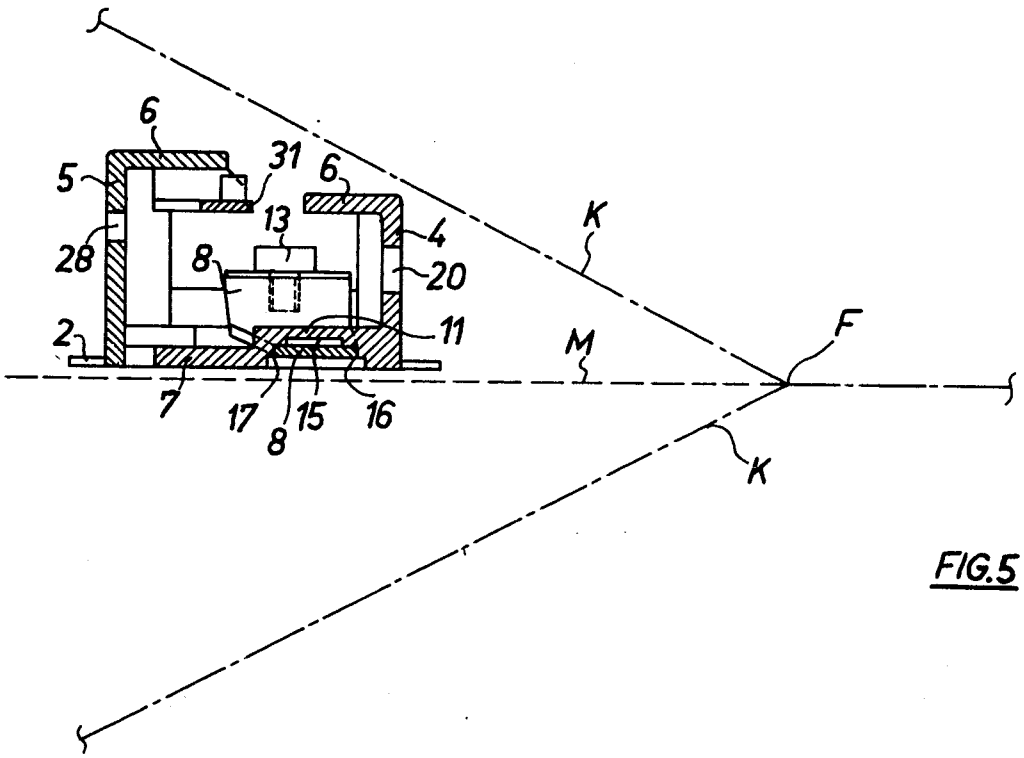
FIG. 5 is an enlarged sectional view taken along the line V—V of FIG. 2.
Figure 6:
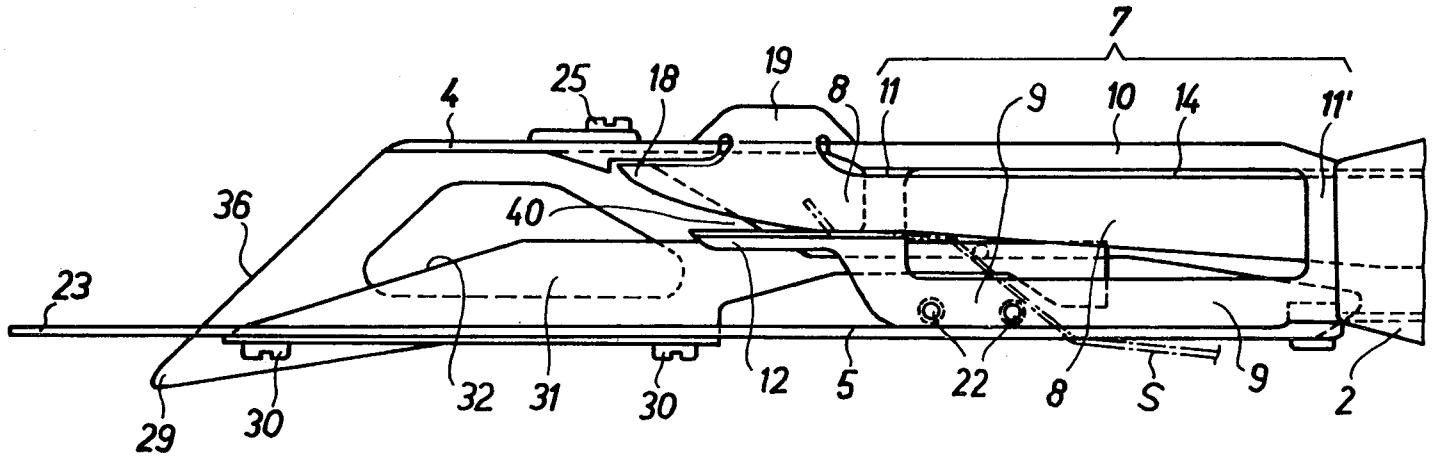
FIG. 6 is a bottom view seen in the direction of arrow VI of FIG. 2.
Figure 7:
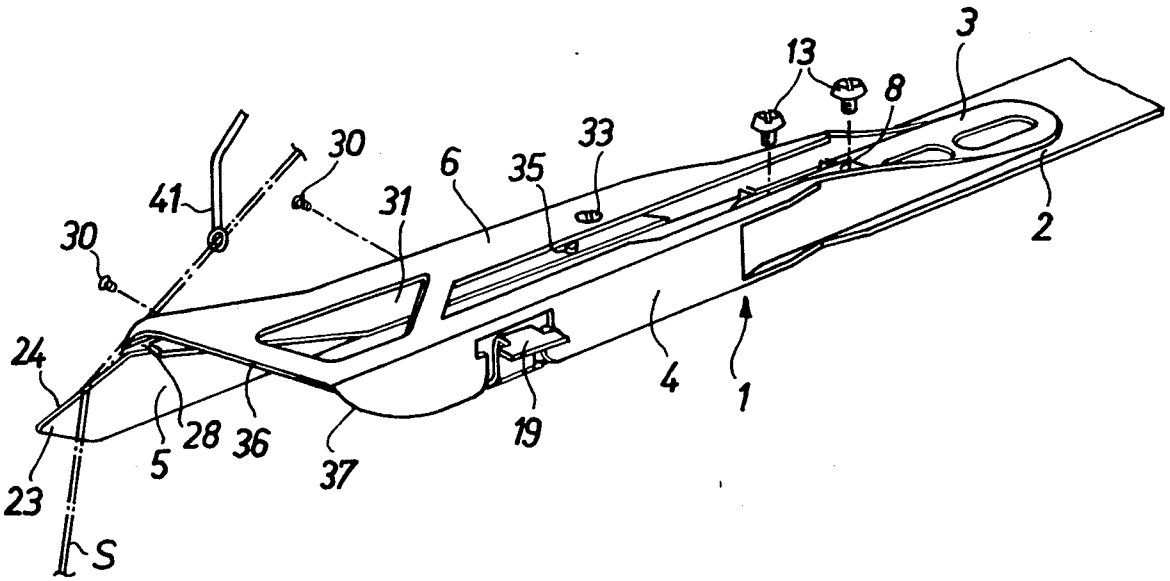
FIG. 7 is a perspective view of the inserting carrier cast in a single piece.

The carrier bottom 7 consists of two side strips 9 and 10 which are connected at their front end to a first cross arm 11 and at their rear end to a second cross arm 11'. A forward extending narrow tip 12 is attached to the cross arm 11. The clamping tongue 8 formed by a leaf spring is connected at its rear end by two screws 13 (FIG. 5) to the base 3 and extends in the longitudinal direction of the carrier 1 through a cutout 14 in the carrier bottom 7 formed between the side strips 9 and 10 and the cross arm 11. The cross arm 11 is provided on its bottom with a U-shaped guide groove 15 with stepped side walls 16 and 17. The side walls 16 and 17 are so developed that the width of the groove 15 decreases in wedge shape from the bottom to the top. The clamping tongue 8 which is guided in the stepped portion of the groove 15 is provided in this region of guidance with a trapezoidal cross-section with side edges which taper from the bottom to the top so that a wedge surface guide is present between the clamping tongue 8 and the groove 15.

The portion of the side edge of the clamping tongue 8 facing the point F of the shed serves as guide and abutment for the clamping tongue. The portion of the side edge of the clamping tongue 8 facing away from the point F of the shed which rests against the stepped side wall 17 of the groove 15, together with the side wall 17 and with the edge of the tip 12 of the cross arm 11 adjoining same in the direction towards the tip 18 of the clamping tongue 8 forms the clamping slot 40 for a filling yarn S which is to be grasped. Since the clamping tongue 8 tapers to the point 18 at its front end, the clamping slot 40 widens in wedge shape in forward direction away from the cross arm 11 and thus forms an entrance funnel for the filling yarn S. The side edge of the clamping tongue 8, which also serves to form the clamping slot, may in this connection lead away from the cross arm 11 to the point 18 in a continuous curve or in successive curves of an inclination which increases toward the tip 18.

At its longitudinal edge facing the point F of the shed the clamping tongue 8 has an extension piece 19 which is bent 90° upward from the clamping tongue and then 90° forward towards the tip F of the shed, said extension piece extending into a T-shaped recess 20 in the front side wall 4. The leaf spring which forms the clamping tongue 8 is imparted such an initial stress that in its condition of rest it presses from below against the cross arm 11. The clamping tongue 8 can be swung downward by downward acting force on the attachment piece 19, the lower edge of the transverse arm of the recess 20 serving to limit the amplitude of swing.

The rear side wall 5 is developed at its tip 23 as a warp divider piece. The upper edge of the tip 23 forms an ascending first yarn guide curve 24. Adjoining the first yarn guide curve, an open yarn guide groove 28 is recessed in the rear side wall 5, said groove having a straight portion and a portion which descends obliquely downward. The yarn guide groove 28 is covered on top by a horn 29 attached to the cover surface 6 which is staggered with respect to the warp divider piece and extends out in the direction away from the point F of the shed, so that loose warp yarns cannot enter into the yarn guide groove 28.

On the rear side wall 5, within the region of the linear portion of the yarn guide groove 28 a horizontally extending deflection element 31 extending towards the shed point F is fastened by screws 30. The cover surface of the deflection element 31 lies at the level of the lower edge of the straight portion of the yarn guide groove 28. The edge of the deflection element 31 which leads away from the groove 28 is developed as a second yarn guide curve 32. The deflection element 31 is attached at its rear end by a screw 33 and a washer 34 to the cover surface 6. The deflection element 31 also bears an upward extending stop pin 35.

The edge 36 of the cover surface 6 which adjoins the horn 29 extends obliquely to the base 3 to the front side wall 4 and passes into the rounded edge 37 of the front side wall 4. The edge 36 and the edge 37 serve as a third yarn guide curve which leads in a continuous path to the clamping slot from the horn 29 and thus from the upper edge of the yarn guide groove 28.

The manner of operation of the inserting carrier described is as follows: When the inserting carrier 1 is moved by the band 2 out of its position of rest in the direction towards the shed, the first yarn guide curve 24 comes against the filling yarn S, which is guided from the selvage on the insertion side approxinately horizontally to a member 41 of a yarn transfer device. The tensioned filling yarn S slides into the yarn guide groove 28, it being strained between the second and third yarn guide curves 32 and 36, 37. The filling yarn S passes from the second yarn guide curve 32 to the longitudinal edge of the deflection element 31 facing the web point F of the shed and slides up to the stop pin 35. From the third yarn guide curve 36, 37 the filling yarn S passes directly into the clamping slot 40 up to a position corresponding to its thickness, and is clamped fast there. Thereupon, the filling yarn S is cut off between the insertion-side selvage and the clamping slot and the actual insertion of the filling now commences up approximately into the center of the shed where the filling yarn is now taken over in known manner, by an extending carrier. The portion of the filling yarn S offered the extending carrier extends in the inserting carrier 1 from the clamping slot 40 to the longitudinal edge of the deflection element 31 facing the shed tip F and is therefore approximately perpendicular to the warp central plane M. Upon the moving of the empty inserting carrier 1 out of the shed, the clamping tongue extension piece 19 comes against an actuating element, as a result of which the clamping tongue 8 is swung downwards so as to clean dirt off from the clamping slot.

The inserting carrier 1 described, of course, need not consist of the two structural parts 38 and 39 which are screwed together but may, for reasons of rational manufacture and design, be cast in a single piece. In such case, the screws 21, 22, and 25 as well as the contact edges 26 and 27 between the two structural parts 38 and 39 would be eliminated. The extension piece 19 of the clamping tongue 8 need not extend into the T-shape recess 20 of the front side wall 4 but can lie in front of the front side wall 4 so that the recess 20 is unnecessary.

It will be appreciated that various changes and/or modifications may be made within the skill of the art without departing from the spirit and scope of the invention illustrated, described, and claimed herein.

What is claimed is:

1. An inserting carrier for looms with removal of the filling yarn from stationary bobbins, said filling yarn being presented in the carrier in a vertical plane essentially, said carrier having a filling yarn clamping device and a warp divider piece attached to the top of the rear side wall of the carrier facing away from the point of formation of the shed, the upper edge of said divider piece being developed as an ascending first yarn guide curve and passing into an open yarn groove which is covered by a horn which protrudes in a direction away from the point of formation of the shed, characterized by the fact that the filling yarn clamping device is formed from a spring-loaded clamping tongue which is swingable perpendicularly to the central plane of the warp yarn and supported on the bottom surface of the carrier; a second yarn guide curve extending from the rear side wall of the carrier towards the front side wall is connected to the first yarn guide curve; and a third yarn guide curve leads from the horn up to the clamping slot of the clamping tongue.

2. The inserting carrier according to claim 1 in which the third yarn guide curve is formed by a top edge of a cover surface bearing the horn and by a stop edge of a front side wall of the carrier.

3. The inserting carrier according to claim 1 in which said yarn groove has a horizontally extending first portion and an obliquely downward descending second portion.

4. The inserting carrier according to claim 2 in which said yarn groove has a horizontally extending first portion and an obliquely downward descending second portion.

5. The inserting carrier according to claim 3 in which a plate-shaped deflection element extending perpendicularly from the rear side wall of the carrier into the inside of the carrier is fastened to the rear side wall at the height of the lower edge of the horizontal first portion of the yarn groove, and the top edge of said deflection element forms the second yarn guide curve.

6. The inserting carrier according to claim 5 in which the base, the two side walls, the bottom, and the cover surface of the carrier are formed as a unit.

* * * * *